US006419350B1

(12) United States Patent
Abe et al.

(10) Patent No.: US 6,419,350 B1
(45) Date of Patent: Jul. 16, 2002

(54) INK TANK, RECORDING HEAD CARTRIDGE AND INK JET RECORDING APPARATUS

(75) Inventors: Tsutomu Abe, Isehara; Yasuo Kotaki, Yokohama; Masashi Ogawa, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/645,316

(22) Filed: Aug. 25, 2000

(30) Foreign Application Priority Data

Aug. 30, 1999 (JP) ..... 11-243535

(51) Int. Cl.[7] ..... B41J 2/175
(52) U.S. Cl. ..... 347/86
(58) Field of Search ..... 347/84, 85, 86, 347/87, 93

(56) References Cited

U.S. PATENT DOCUMENTS

| | | | | | |
|---|---|---|---|---|---|
| 4,313,124 | A | | 1/1982 | Hara | 347/57 |
| 4,345,262 | A | | 8/1982 | Shirato et al. | 347/10 |
| 4,459,600 | A | | 7/1984 | Sato et al. | 347/47 |
| 4,463,359 | A | | 7/1984 | Ayata et al. | 347/56 |
| 4,558,333 | A | | 12/1985 | Sugitani et al. | 347/65 |
| 4,723,129 | A | | 2/1988 | Endo et al. | 347/56 |
| 4,740,796 | A | | 4/1988 | Endo et al. | 347/56 |
| 5,481,289 | A | * | 1/1996 | Arashima et al. | 347/93 |
| 5,489,932 | A | * | 2/1996 | Ceschin et al. | 347/87 |
| 5,567,373 | A | | 10/1996 | Sato et al. | 264/112 |
| 5,583,549 | A | | 12/1996 | Ujita et al. | 347/86 |
| 5,619,237 | A | * | 4/1997 | Inoue et al. | 347/86 |
| 5,619,239 | A | | 4/1997 | Kotaki et al. | 347/86 |
| 5,631,682 | A | * | 5/1997 | Takata | 347/86 |
| 5,721,577 | A | * | 2/1998 | Ostermeier et al. | 347/86 |
| 5,805,188 | A | | 9/1998 | Nakajima et al. | 347/87 |
| 5,852,457 | A | | 12/1998 | Kotaki et al. | 347/86 |
| 5,903,294 | A | | 5/1999 | Abe et al. | 347/87 |
| 6,086,192 | A | * | 7/2000 | Kurata et al. | 347/86 |
| 6,116,722 | A | | 9/2000 | Sato et al. | 347/85 |
| 6,137,512 | A | | 10/2000 | Higuma et al. | 347/86 |
| 6,168,266 | B1 | * | 1/2001 | Ishinaga et al. | 347/86 |
| 6,234,618 | B1 | | 5/2001 | Yamamoto et al. | 347/86 |

FOREIGN PATENT DOCUMENTS

| | | |
|---|---|---|
| EP | 755794 | 1/1997 |
| JP | 59-123670 | 7/1984 |
| JP | 59-138461 | 8/1984 |

* cited by examiner

*Primary Examiner*—Anh T. N. Vo
(74) *Attorney, Agent, or Firm*—Fitzpatrick, Cella, Harper & Scinto

(57) ABSTRACT

An ink tank having an absorbing member for holding therein ink to be supplied to a recording head for discharging ink to thereby effect recording, a tank container containing the absorbing member therein, a buffer portion capable of temporarily containing the ink therein, and an atmosphere communicating port disposed in the buffer portion and communicating the interior of the ink containing portion with the atmosphere, the buffer portion is disposed on a side portion of the absorbing member, and the direction from the absorbing member toward the buffer portion is a direction intersecting with the scanning direction of a carriage.

17 Claims, 13 Drawing Sheets

INK TANK, RECORDING HEAD CARTRIDGE AND INK JET RECORDING APPARATUS

BACKGROUND OF THE INVENTION

1. Field of the Invention

This invention relates to an ink tank for supplying ink to an ink jet head for discharging ink to thereby effect recording, a recording head cartridge and an ink jet recording apparatus.

2. Related Background Art

An ink tank for supplying ink to a recording head for discharging ink to thereby effect recording is generally provided with an absorbing member for holding the ink therein, a tank container containing the absorbing member therein, and an atmosphere communicating port communicating the interior of the tank container with the atmosphere.

Also, a space portion (buffer portion) not including the absorbing member is provided in the tank container, and the buffer portion temporarily contain therein the ink going out of the interior of the absorbing member due to a change in the environment around the ink tank to thereby prevent the leakage of the ink from the ink tank to the outside.

As the ink absorbing member for holding the ink therein, use has heretofore been made of a foamed material typified by urethane. Also, in recent years, as a material replacing the foamed material such as urethane, there has been proposed an absorbing member using a compressed fiber-like material comprising chemically more stable polyolefin resin.

However, in the prior-art ink tank as described above, the ink going out of the absorbing member due to a change or the like in the external environment stays in the buffer portion, and when in that state, a force such as a shock is applied from outside, the ink in the buffer portion may leak to the outside.

Also, generally, the ink tank is carried on the carriage of an ink jet recording apparatus, but the carriage is reciprocally scanned and therefore, the ink moves from the interior of the absorbing member to the buffer portion by the acceleration or inertia force during that scanning, and it is also conceivable that the ink in the buffer portion further leak to the outside.

SUMMARY OF THE INVENTION

The present invention has been made in order to solve the above-noted problems peculiar to the prior art and the object thereof is to provide an ink tank suppressing the leakage of ink to the outside, a recording head cartridge in which the ink tank is mounted, and an ink jet recording apparatus on which the recording head cartridge is carried.

To achieve the above object, the ink tank of the present invention is an ink tank having an absorbing member for holding therein ink to be supplied to a recording head for discharging ink to thereby effect recording, a tank container containing the absorbing member therein, a buffer portion capable of temporarily containing the ink therein, and an atmosphere communicating port disposed in the buffer portion and communicating the interior of the ink containing portion with the atmosphere, characterized in that the buffer portion is disposed on the side portion of the absorbing member, and the direction from the absorbing member toward the buffer portion is a direction intersecting with the scanning direction of a carriage.

Also, another form of the ink tank of the present invention is an ink tank having an absorbing member for holding therein ink to be supplied to a recording head for discharging ink to thereby effect recording, a tank container containing the absorbing member therein, a buffer portion capable of temporarily containing the ink therein, and an atmosphere communicating port disposed in the buffer portion and communicating the interior of the ink containing portion with the atmosphere, characterized in that the absorbing member is of a convex shape in which at least two opposed surfaces swell outwardly, and has a bottom surface buffer portion disposed between the absorbing member and the bottom surface of the ink tank and capable of temporarily containing the ink therein, and a clearance communicating the buffer portion and the bottom surface buffer portion with each other.

In the ink tank constructed as described above, the buffer portion is disposed in the direction intersecting with the scanning direction of the carriage, whereby the ink only moves in the interior of the absorbing member and is prevented from moving to the buffer portion and therefore, a change in the negative pressure in the interior of the ink tank is suppressed. Also, even if the carriage changes its scanning direction, whereby an inertia force acts on the ink in the ink tank, the ink will not directly move into the buffer portion.

Also, even when the ink flows out into the buffer portion, the ink is again taken in quickly from the side of the absorbing member and full use of the ink is achieved well because the buffer portion is located on the side portion of the ink tank.

On the other hand, the absorbing member is of a convex shape in which two opposed surfaces swell outwardly, and has a bottom surface buffer portion disposed between the absorbing member and the bottom surface of the ink tank and capable of temporarily containing the ink therein, and a clearance communicating the buffer portion and the bottom surface buffer portion with each other, whereby the ink moving from the absorbing member to the bottom surface side of the interior of the ink tank can be temporarily retracted into the bottom surface buffer portion. Further, by the bottom surface buffer portion and the buffer portion being communicated with each other by the clearance, the ink overflowing to the bottom surface buffer portion can be prevented from leaking out from the recording head by the ambient temperature rise.

The present invention also provides a recording head cartridge in which the above-described ink tank can be removably carried, and an ink jet recording apparatus.

DESCRIPTION OF THE PREFERRED EMBODIMENTS

The invention will hereinafter be described with reference to the drawings.

Figure 1:
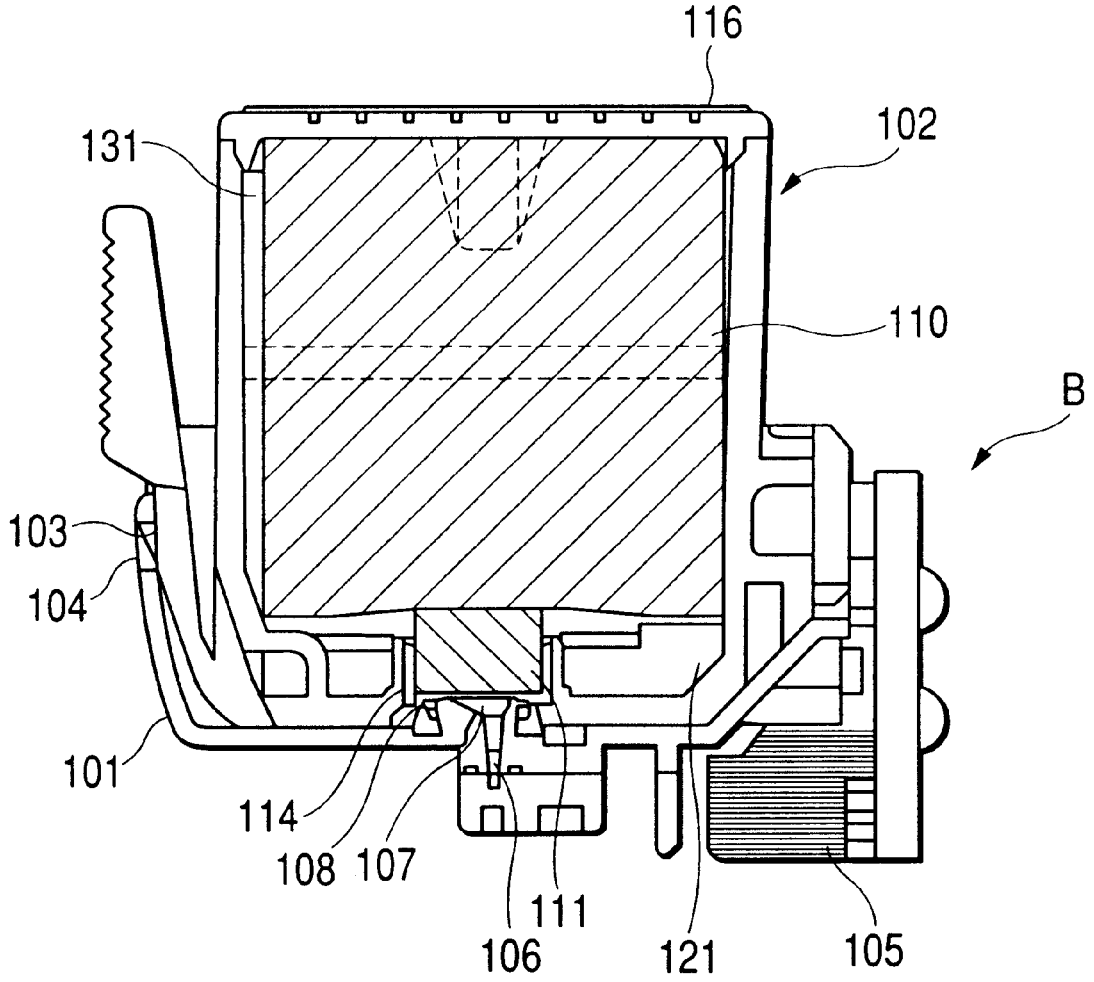
FIG. 1 is a cross-sectional view showing the structure of the ink tank of the present invention.
Figure 2:
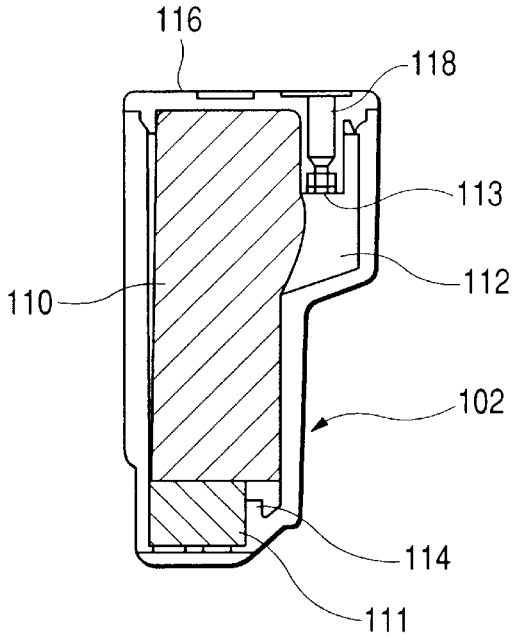
FIG. 2 is a side cross-sectional view showing the structure of the ink tank of FIG. 1 as it is seen in the direction of arrow B in FIG. 1.

FIG. 1 is a cross-sectional view showing the structure of the ink tank of the present invention, and FIG. 2 is a side cross-sectional view showing the structure of the ink tank of FIG. 1 as it is seen in the direction of arrow B in FIG. 1.

As shown in FIG. 1, the ink tank 102 is provided with a lock portion 103 for fixing the ink tank 102 to an ink tank holder 101 provided with a recording head 105. The ink tank 102 is fixed to the ink tank holder 101 by the lock portion 103 being fitted in an opening portion 104 for the lock provided in the ink tank holder 101. At this time, a filter 107 provided at the distal end of an ink flow path 106 for supplying ink to a recording head 5 moves from an ink supply port 108 into the ink tank 102, and is brought into pressure contact with the supplying member 111 of the ink supply port portion, whereby a path along which the ink may flow is secured, and it becomes possible to supply the ink to the recording head 105.

As shown in FIG. 2, the ink tank 102 is provided with an absorbing member 110 for absorbing and holding the ink therein, the supplying member 111 located between the absorbing member 110 and the ink supply port 108 for delivering the ink from the absorbing member 110 to the ink tank holder 101, a buffer portion 112 for temporarily holding therein the ink leaking from the absorbing member 110 into the interior of the tank, and an atmosphere communicating port 113 for communicating the interior of the ink tank 102 with the atmosphere to keep the internal pressure of the ink tank 102 at the atmospheric pressure.

The internal opening portion of the atmosphere communicating port 113 is disposed substantially at the center of the buffer portion 112 so that when the ink has moved from the interior of the absorbing member 110 to the buffer portion 112, the ink may not leak to the outside even if the ink tank 102 is brought into any posture.

As the absorbing member 110 and the supplying member 111, use is made of a fiber absorbing material in which a bundle of fibers comprising polyolefin resin and having directionality is compressed and the fibers are heat-melted and coupled together, and are set to a density state suited for each member, and this material is cut into predetermined dimensions and contained in a tank container.

Figure 3:
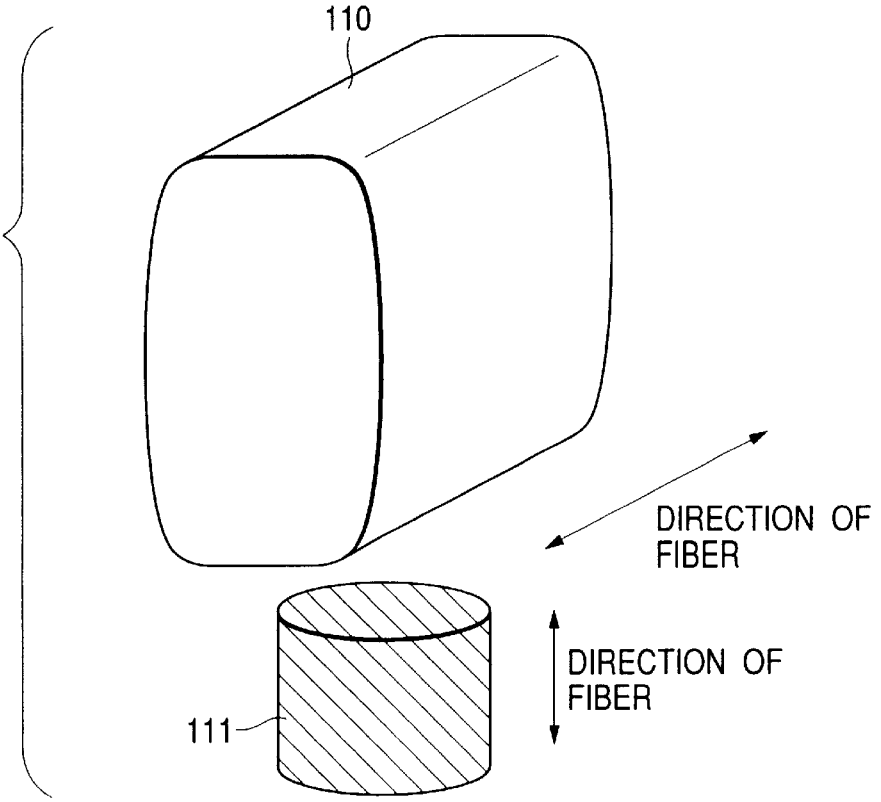
FIG. 3 is a perspective view showing the shapes and directions of fibers of the absorbing member and supplying member of FIG. 1.

The absorbing member 110 has an outwardly swollen convex shape having elasticity, as shown in FIG. 3, and is designed such that a reaction force is created when it is contained into the ink tank. Also, in the present embodiment, the fiber density of the outer peripheral portion is made high as compared with the fiber density of the interior, whereby the ink holding property of the outer peripheral portion is more heightened.

The supplying member 111 is such that the fibers thereof are ranged in a direction intersecting with the surface of the filter 107, preferably a direction perpendicular thereto, and the absorbing member 110 is contained in the ink tank so that the fibers thereof may be ranged in a direction intersecting with the direction of fibers of the supplying member 111, preferably a direction orthogonal thereto. By doing so, it becomes possible to stably supply the ink to the recording head 105 while creating proper negative pressure for holding the ink.

Also, as shown in FIG. 1, a bottom surface buffer portion 121 is provided between the bottom surface of the interior of the ink tank 102 and the absorbing member 110 to thereby prevent the ink having moved to the bottom surface side of the ink tank 102 from concentrating in the periphery of the supplying member 111 and leaking from the ink supplying port 108 to the outside. The bottom surface buffer portion 121 and the buffer portion 112 provided on the side of the ink tank 102 communicate with each other through a clearance 131 which is a gap provided between the inner wall of the ink tank and the absorbing member 110.

Each constituent of the ink tank 102 will now be described in detail with reference to the drawings.

Absorbing Member

The absorbing member 110 used in the ink tank of the present invention will first he described with reference to FIGS. 1 and 2 and by the use of FIG. 3. FIG. 3 is a perspective view showing the shapes and the directions of fibers of the absorbing member and the supplying member shown in FIG. 1.

As the absorbing member 110 in the present embodiment, use is made of a fiber absorbing material in which a bundle of fibers comprising thread-like olefin resin I having its surface coated with other olefin resin II lower in melting point than that is bundled with desired density.

This fiber absorbing material is such that for example, the bundle of fibers was heated at a temperature whereat the olefin resin II in the surface layer was melted, whereafter it was passed through dice of a predetermined shape and was thereby compressed, and the rate at which the fibers contacted with one another was increased and the molten surface layer was fusion-bonded. At this time, the surface layer of the fiber absorbing material is quickly cooled by the dice and therefore only the surface layer is hardened earlier. On the other hand, the interior of the fiber absorbing material gradually begins to be hardened with the natural emission of heat, and a force with which the fibers try to return to their original state works, and the surface layer hardened earlier tries to hold it down and therefore, the fiber absorbing material is formed in a convex shape swollen with an elastic force in a direction substantially perpendicular to the direction of the fibers.

The elastic force the fiber absorbing material has is controllable depending on the condition under which the bundle of fibers is heated, the condition under which the bundle of fibers is passed through the dice, and the kind of the fibers. When for example, dice of a square shape are used, the corner portions of the bundle of fibers become stronger in compressive force than the surface portion thereof when it is passed through the dice and therefore, the fibers fusion-bond at many regions. Therefore, the corner portions are formed harder than the surface portion and an elastic force can be given chiefly to the surface portion.

The absorbing member 110 in the present embodiment comprises the above-described fiber absorbing material, and as shown in FIG. 3, the central portions thereof are formed into an outwardly swollen convex shape. By the two opposed surfaces of the absorbing member 110 being thus formed into a convex shape, the closely contacting property thereof with the inner surface of the ink tank 102 is improved by the elastic force thereof when the absorbing member is contained into the ink tank 102 and therefore, the deviation of the absorbing member 110 can be suppressed. It is preferable for the suppression of the deviation of the absorbing member 110 to position the convex surfaces of the absorbing member 110 on the surfaces of the ink tank 102 which have a maximum area at this time.

When as shown in FIG. 1, the supplying member 111 is forced into the interior of the ink tank by the pressure from the filter 7, the absorbing member 110 holds its own position by the elastic force thereof and therefore, the pressure contact force between the supplying member 111 and the absorbing member 110 increases and a capillary force created in the portion of contact between the absorbing member 110 and the supplying member 111 becomes great and the ink concentrates in the vicinity of the supplying member 111. Thereby it becomes possible to stably supply the ink from the absorbing member 110 to the supplying member 111.

Also, by utilizing this elastic force, the supplying member 111 is always stably brought into pressure contact with the absorbing member 110 even if the ink tank 102 is repetitively mounted on the ink tank holder 101, and therefore there can be provided an ink tank 102 of high reliability in which the possibility of exhaustion of ink is small.

Supplying Member

The supplying member 111 used in the ink tank of the present invention will now be described with reference to FIGS. 1 and 2 and by the use of FIG. 3.

The supplying member 111 is located between the absorbing member 110 and the filter 107 and serves to stably supply the ink from the absorbing member 110 to the filter 107. The supplying member 111 supplies the ink from the absorbing member 110 to the filter 107 while receiving an upwardly pressure-contacting force from the filter 107 and receiving a downward reaction force from the absorbing member 110 when the ink tank 102 is mounted on the holder.

If at this time, the fiber density of the supplying member 111 is too high, the resistance when the ink flow will become great and the supply of the ink cannot catch up and therefore, printed images may become blurred. Also, the supplying member 111 will become too hard and therefore, it may damage the filter 107 when the ink tank 102 is mounted on the ink holder 101.

If conversely, the fiber density of the supplying member 111 is too low, the capillary force will become too weak and it may in some cases become difficult to direct the ink stably from the absorbing member 110. Also, the supplying member 111 will become too soft and therefore, the fibers of the supplying member 111 will buckle and will be deformed and crushed by the forces from the filter 107 and the absorbing member 110 when the filter 107 is brought into pressure contact therewith, and therefore a predetermined pressure contact force will not be obtained and it will become impossible to supply the ink stably.

In the present embodiment, a bundle of fibers heated and shaped by a method similar to that for the absorbing member 110 is used as the supplying member 111. The supplying member 111 is designed such that the fibers thereof are ranged in a direction substantially perpendicular to the surface of the filter 107, and the pressure contact force thereof with the absorbing member 110 is increased while the fiber density of the outer peripheral portion thereof is heightened to thereby keep the shape thereof during the contact thereof with the filter 107, whereby the capillary force around the portion of contact is heightened to thereby make the ink held in the absorbing member 110 concentrate in the vicinity of the boundary with the supplying member. Also, the fiber density of the outer peripheral portion is heightened to thereby strengthen the capillary force and therefore, once the ink permeates, the supplying member is always maintained in a state in which it holds the ink therein. Thereby, the ink is steadily present around the supplying member 111, and during the supply of the ink, the air is prevented from being introduced from the outer peripheral portion of the supplying member and affecting print.

The fiber density of the interior of the supplying member 111 is made lower than that of the outer peripheral portion thereof so that the resistance to the flow of the ink may not become great and the ink necessary for printing can be supplied stably. By the fiber density being thus made low, the hardness of the supplying member is made appropriate, whereby it becomes possible to prevent the filter 107 from being damaged when the filter 107 is brought into pressure contact with the supplying member 111 and to make the supplying member reliably abut against the filter 107.

As shown in FIGS. 1 and 2, a guide frame 114 for guiding the supplying member 111 is provided in the interior of the ink tank 102 so that the supplying member 111 may appropriately return to its initial position when the ink tank 102 is detached from the ink tank holder 101. The inner wall of the guide frame 114 has an inclination so that the supplying member 111 pushed upwardly by the filter 107 during the mounting of the ink tank may smoothly return to its initial position along the guide frame 114 during the detachment of the ink tank 102. In the present embodiment, the angle of the inner wall of the guide frame 114 is about 10. Also, the height of the guide frame 114 is made slightly lower than the supplying member 111 to thereby maintain the abutting state thereof against the absorbing member 110 so that the atmosphere may not be introduced.

Buffer Portion

The buffer portion provided in the ink tank of the present invention will now be described with reference to FIGS. 1 and 2 and by the use of FIGS. 4A to 6.

Figure 4B:
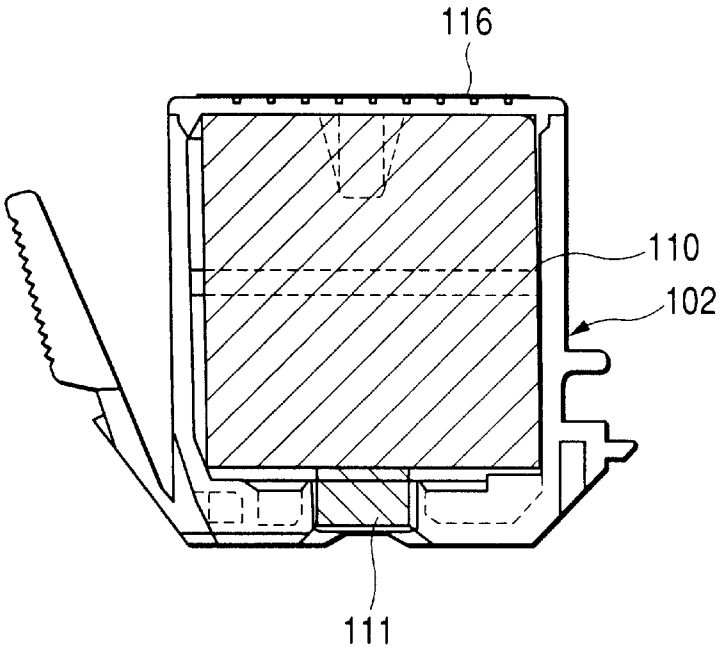
FIGS. 4A and 4B show the manner in which the absorbing member is contained in the ink tank, FIG. 4A being a cross-sectional view of an example of the prior art, FIG. 4B being a cross-sectional view of an embodiment of the present invention.
Figure 4A:
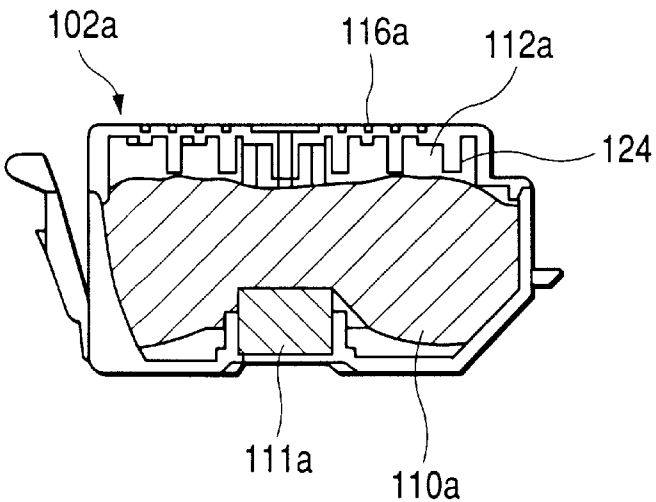
Figure 5A:
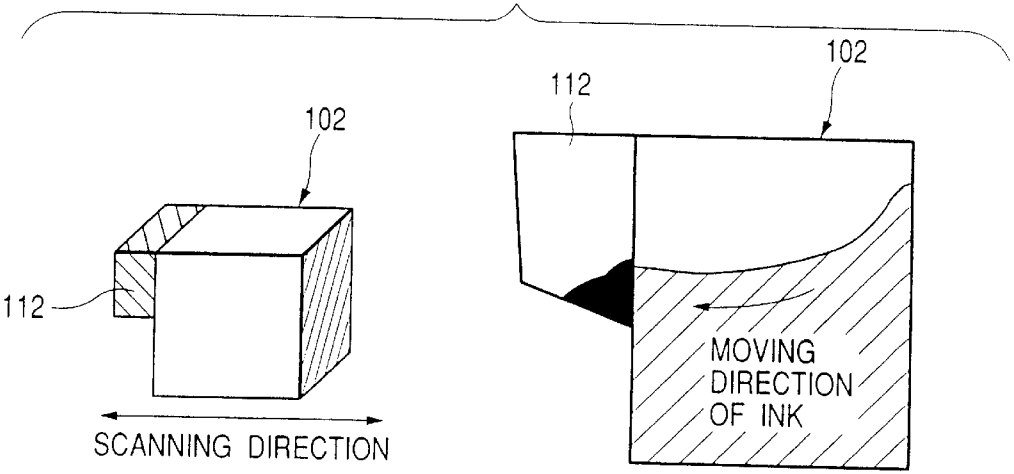
FIGS. 5A and 5B show the manner in which ink moves in the ink tank, FIG. 5A being a cross-sectional view showing an ink tank in which a buffer portion is disposed in the same direction as the scanning direction of a carriage, FIG. 5B being a cross-sectional view showing an ink tank in which a buffer portion is disposed in a direction intersecting with the scanning direction of the carriage.
Figure 5B:
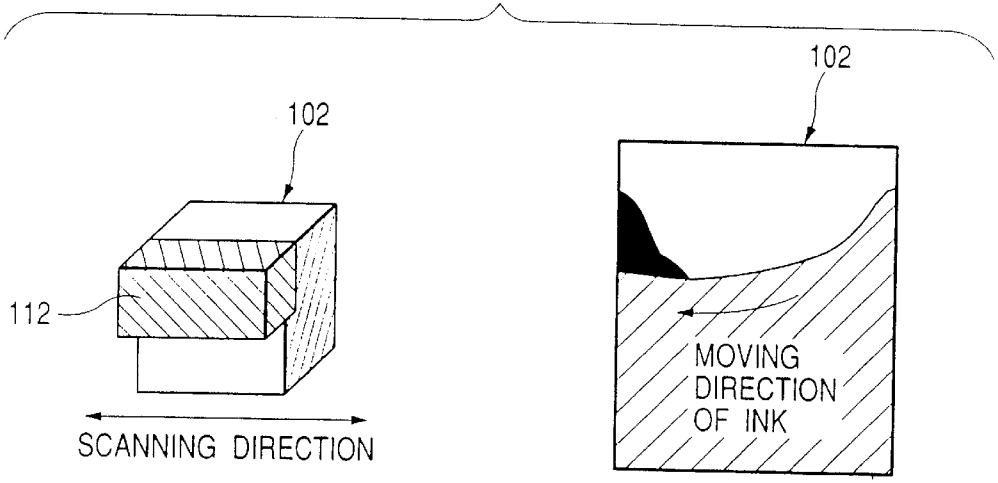
Figure 6:
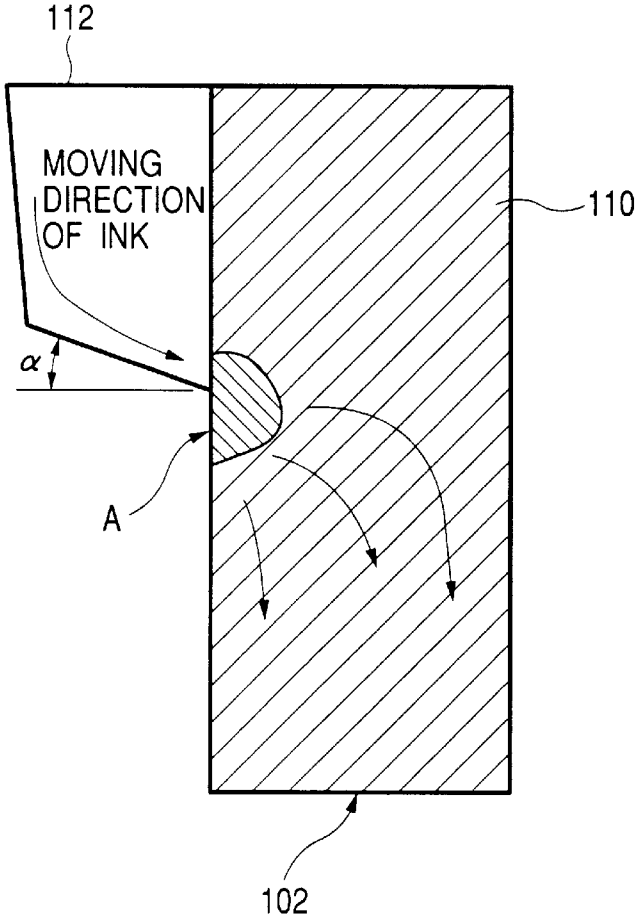
FIG. 6 is an enlarged cross-sectional views of essential portion showing the structure of the buffer portion of FIG. 2.

FIGS. 4A and 4B show the state of the absorbing member contained in the ink tank, FIG. 4A being a cross-sectional view of the ink tank according to the prior art, FIG. 4B being a cross-sectional view of the ink tank of the present invention. FIGS. 5A and 5B show the manner in which the ink moves in the ink tank, FIG. 5A being a cross-sectional view showing an ink tank in which a buffer portion is disposed in the same direction as the scanning direction of a carriage, FIG. 5B being a cross-sectional view showing an ink tank in which a buffer portion is disposed in a direction intersecting with the scanning direction of the carriage. FIG. 6 is a cross-sectional view in which essential portions are enlarged and which shows the structure of the buffer portion shown in FIG. 2. Here, the "intersecting" in "a direction intersecting with the scanning direction of the carriage" indicates the intersection in the horizontal direction of gravity, as shown.

The ink held in the absorbing member 110 moves in the absorbing member 110 by changes in ambient environment (such as temperature, pressure and inertia force during the movement of the carriage). For example, when temperature rises, the air in a region wherein the ink in the interior of the absorbing member 110 does not permeate may expand and force out the ink. Also, generally the viscosity of the ink lowers and therefore the ink becomes liable to move. The ink forced out of the absorbing member 110 moves in a direction in which it is liable to move while being affected by gravity. As shown in FIG. 2, the absorbing member 110 and the supplying member 111 are contained in the ink tank and therefore, the ink forced out of the absorbing member 110 temporarily collects in the buffer portion 112. Design is made such that in the initial state immediately after the ink has been poured into the ink tank 102, the ink is not permeated in the absorbing member 110 near the buffer portion 112. This is in order to form the buffer portion in the absorbing member to the movement of the ink to the buffer portion 112 by the change in the ambient environment during transportation to thereby prevent the leakage of the ink to the outside of the ink tank.

As shown in FIG. 4A, in the ink tank according to the prior art, a buffer portion 112*a* is disposed in the upper portion of an absorbing member 110*a*, and a reaction force to a supporting member 111*a* is created while a space as the buffer portion 112*a* is maintained and therefore, ribs 124 are provided on the inner surface of a lid 116*a* to thereby regulate the upper surface position of the absorbing member 110*a*.

The absorbing member 110*a* is strong in pressure contact force at the regions thereof abutting against the ribs 124 and therefore is compressed and becomes strong in the ink holding force, and becomes weak in pressure contact force at the regions thereof not abutting against the ribs 124 and thus, regions high in negative pressure irregularly exist above the absorbing member 110*a*.

If printing is effected in such a state, when the ink in the absorbing member 110*a* decreases, a layer of air is formed between the ink held in a region pushed by the ribs 124 and the ink supplied to the recording head and therefore, the ink supply path breaks and the amount of ink usable for printing decreases. Also, if the ambient environment changes in this state, the ink strongly held in the upper portion of the absorbing member 110*a* may move and leak out of the ink tank through the atmosphere communicating port. Also, the size of the ink tank in a vertical direction which is the direction of gravity is enlarged and the size of the recording apparatus in the height direction thereof is increased.

In the present embodiment, the buffer portion 112 is disposed on the side of the ink tank 102, and as shown in FIG. 4A, the upper surface of the absorbing member 110*a* is held down by the inner surface of a lid 116*a*, whereby the area in which a reaction force to the supplying member 111*a* is created is widened so that there may be no unbalance of the amount of compression of the supplying member 111*a* and also the reaction force may be stably applied. Also, there is no region in the upper portion of the absorbing member 110*a* in which strong negative pressure is created and therefore, when the filter 107 is brought into pressure contact with the supplying member 111*a*, the ink comes to uniformly gather around the supplying member 111*a*.

The ink tank 102 is carried on a carriage provided in an ink jet recording apparatus which will be described later and is reciprocally scanned. Here, when as shown in FIG. 5A, the buffer portion 112 is disposed in the same direction as the scanning direction of the carriage, the possibility of the ink in the absorbing member 110 being moved to the buffer portion 112 by the inertia force thereof is high. When during printing, the ink goes out from the absorbing member 110 to the buffer portion 112, the negative pressure in the ink tank 102 becomes high, and when the ink is again absorbed into the absorbing member 110, the negative pressure in the ink tank becomes low. When the negative pressure in the ink tank 102 thus fluctuates during printing, it may adversely affect the printing. Also, the ink in the buffer portion 112 may leak to the outside by the vibrations by the scanning of the carriage.

In the present embodiment, as shown in FIG. 5B, the buffer portion 112 is disposed in a direction intersecting with the scanning direction of the carriage. By doing so, the ink only moves in the interior of the absorbing member 110 with the movement of the carriage and does not move to the buffer portion 112 and therefore, the change in the negative pressure in the ink tank can be restrained to thereby reduce the influence thereof upon printing. Also, even if the carriage changes its scanning direction, whereby an inertia force acts on the ink in the ink tank, the ink will not directly move into the buffer portion 112 and therefore, the leakage of the ink from the atmosphere communicating port 113 can be restrained.

The present embodiment is applicable to an urethane sponge, a fiber absorbing material, a felt absorbing material or the like as a material for creating negative pressure in the ink tank, and is particularly effective when use is made of the fiber absorbing material by which the movement of the ink in the absorbing member is relatively easy.

In the present embodiment, the fiber absorbing material having fiber directionality is used as the absorbing member 110, and the fibers of the fiber absorbing material are ranged in the left to right direction of FIG. 5B (the widthwise direction of the buffer portion 112), whereby there is provided structure in which it is difficult for the ink to move in the direction from the fiber absorbing material toward the buffer portion 112, and this is more preferable.

Now, as described above, the ink put out of the absorbing member 110 by the change in the environment around the ink tank temporarily collects in the buffer portion 112. If the ambient environment restores its normal state, the absorbing member 110 tries to again hold the ink therein. The ink present in the buffer portion 112 at this time is divided into the ink moving to the absorbing member 110 side by the gravity of the ink, the ink pulled by the capillary force of the absorbing member 110, and the ink temporarily remaining in the buffer portion 112. The ink remaining in the buffer portion 112 is sometimes returned into the absorbing member 110, for example, by an inertia force acting on the ink tank during printing.

In the present embodiment, as shown in FIG. 6, the bottom surface of the buffer portion 112 is provided with an angle of inclination a so that even when the into is in a stationary state, the ink may be carried along the wall surface by gravity and be absorbed into the absorbing member 110. By the ink being returned to the absorbing member 110, the negative pressure in the absorbing member 110 becomes low, but the ink is in a stationary state and therefore, recording dignity is not deteriorated. In the present embodiment, the angle of inclination a of the bottom surface of the buffer portion 112 is 10° to 20°. Also, when the absorbing member 110 is contained in the ink tank, a portion thereof juts out into the buffer portion 112 by the elastic force thereof as shown in FIG. 2 and therefore, the lower area of the buffer portion 112 shown in FIG. 6, i.e., the area in the absorbing member which is below the buffer portion, becomes highly compressed. Also, an area A is particularly compressed and becomes the boundary area of the fiber density. In the present embodiment, the absorbing member is formed larger by about 6 mm than the inner wall surface of the ink tank, and is compressed when inserted into the ink tank.

Accordingly, the capillary force in the area A increases and it becomes possible to quickly draw in the ink in the buffer portion 112. Also, the fiber density of the area A heightens, whereby the ink is restrained from moving from the lower portion of the ink tank 102 to the buffer portion 112. Also, in the present invention, the buffer portion 112, as shown in FIG. 6, is located on a side of the ink tank. By this construction, even if the ink flows out into the buffer portion 112, the ink will be quickly returned into the absorbing member 110 as described above. Further, the ink is positively taken into the central to lower areas of the absorbing member 110 and therefore, connects with the ink in the absorbing member 110, and the ink can be reliably directed to the supplying member 111 and consumed. That is, it never happens that the ink remains in the absorbing member 110, and the consumption of the ink becomes possible, and as shown in FIG. 4A, there is not the compression by the ribs in the buffer portion 112 and therefore, the ink does not remain in that region.

Atmosphere Communicating Port

Figure 8A:
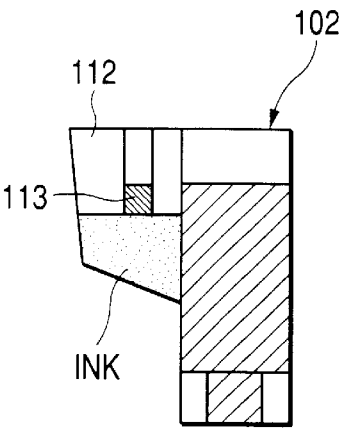
FIGS. 8A, 8B, 8C and 8D are cross-sectional views showing the position of the atmosphere communicating port provided in the ink tank, and showing the states of the ink in the buffer portion relative to the posture of the ink tank.
Figure 8B:
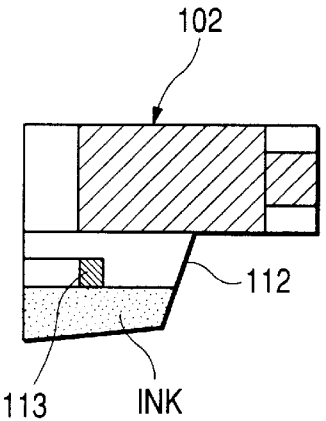
Figure 8C:
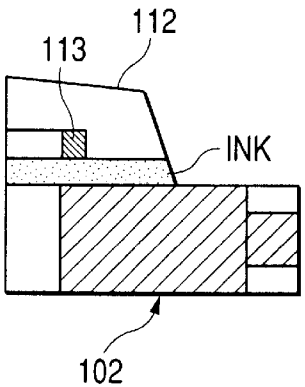
Figure 8D:
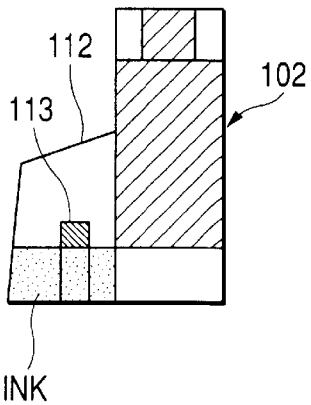
Figure 9:
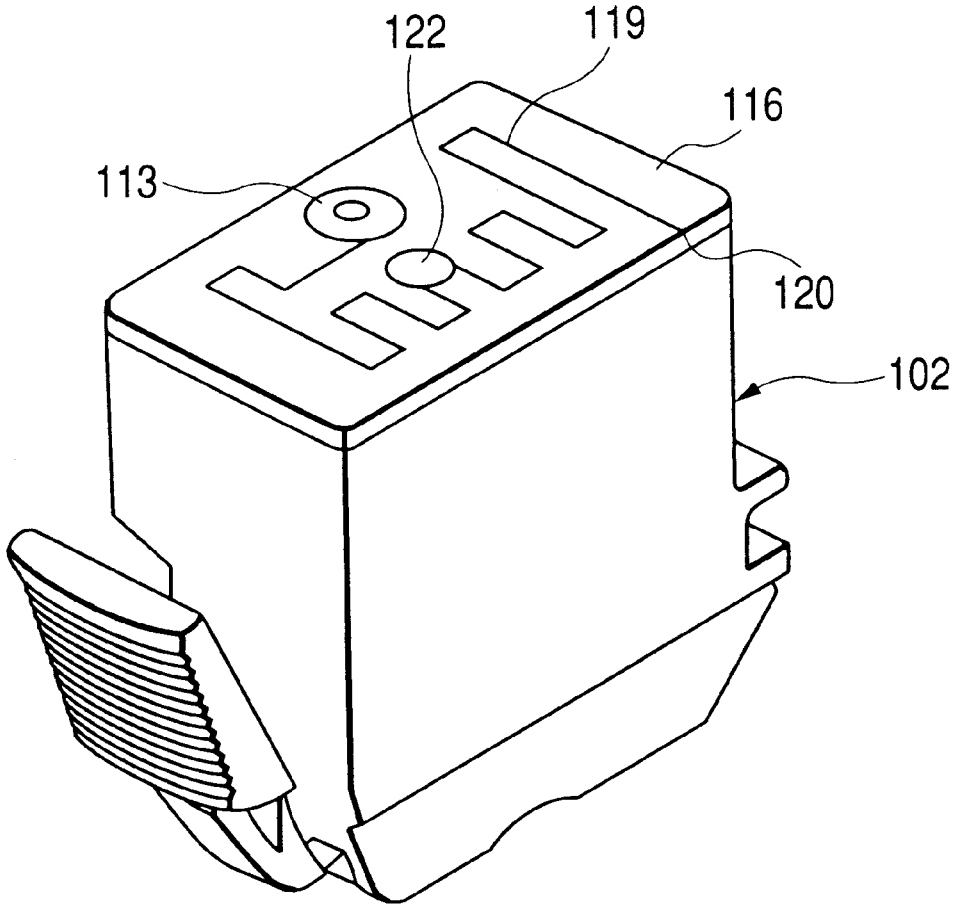
FIG. 9 is a perspective view of the ink tank of FIG. 1 as it is seen from the direction of its upper surface.

The atmosphere communicating port provided in the ink tank of the present invention will now be described with reference to FIGS. 1 and 2 and by the use of FIGS. 7 to 9.

Figure 7:
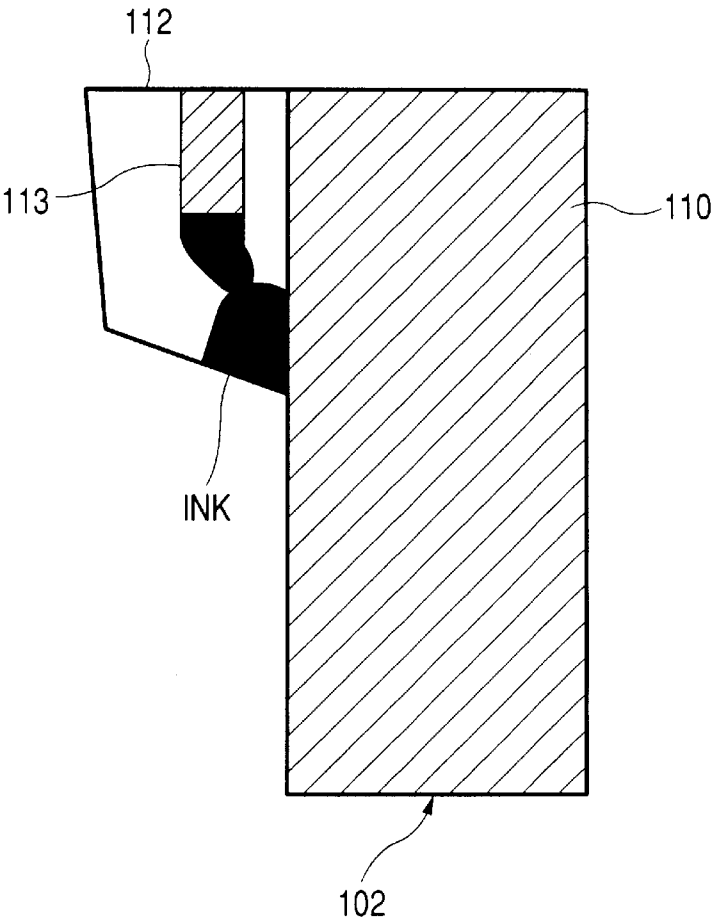
FIG. 7 is a cross-sectional view showing the manner in which ink adhering to the buffer portion is connected to an atmosphere communicating port.

FIG. 7 is a cross-sectional view showing the manner in which the ink adhering to the atmosphere communicating port shown in FIG. 2 and the ink adhering to the buffer portion connect with each other. FIGS. 8A to 8D show the location of the atmosphere communicating port provided in the ink tank, and are cross-sectional views showing the states of the ink in the buffer portion to the postures of the ink tank. FIG. 9 is a perspective view of the ink tank of FIG. 1 as it is seen from its upper surface.

As described above, the interior of the ink tank 102 communicates with the outside by the atmosphere communicating port 113 which is a tubular member (see FIG. 2), and the interior of the ink tank 102 is opened to the atmosphere by the atmosphere communicating port 113 to thereby keep the internal pressure of the ink tank 102 constant.

When as shown in FIG. 7, the ink adheres to the atmosphere communicating port 113, the ink staying in the buffer portion 112 and the ink adhering to the atmosphere communicating port 113 attract each other by the surface tension thereof, and the path of the ink is formed and the ink becomes liable to leak to the outside. Therefore, it is desirable that the atmosphere communicating port 113 be at a location far from the ink collected in the buffer portion 112.

Also, the ink tank 102 of the present embodiment has the internal opening position of the atmosphere communicating port 113 disposed substantially at the center of the buffer portion 112. By doing so, when as shown in FIG. 8A, the ink tank 102 is in its regular posture, when as shown in FIG. 8B, the ink tank 102 is in a posture wherein the buffer portion 112 is down, when as shown in FIG. 8C, the ink tank 102 is in a posture wherein the buffer portion 112 is up, or even when as shown in FIG. 8D, the ink tank 102 is in a posture inverted from its regular posture, if the ink moved from the absorbing member 110 to the buffer portion 112 is less than about 50% of the volume of the buffer portion 112, the ink does not touch the atmosphere communicating port 113 and therefore, the interior of the ink tank 102 can be maintained opened to the atmosphere.

Also, the atmosphere communicating port 113 in the present embodiment has a space portion 118 (see FIG. 2) between the inner opening and outer opening thereof. Thereby, even if the ink comes: into the atmosphere communicating port, the ink is temporarily held in the space portion 118 and is restrained from leaking from the ink tank 102 to the outside. In the present embodiment, a space portion 118 of $\phi$ 2.5 to $\phi$ 2.0 mm is provided so that the ink may collect therein.

Now, the lid 116 of the ink tank 102 shown in FIG. 1 usually has a seal material or the like stuck thereon to thereby seal the atmosphere communicating port 113 in order to prevent the leakage of the ink to the outside through the atmosphere communicating port 113 and the evaporation of the ink. So, as shown in FIG. 9, a labyrinth-like guide groove 119 connected to the atmosphere communicating port 113 is formed on the outer wall of the lid 116, and a seal material is stuck thereon, thereby the interior of the ink tank 102 is opened to the atmosphere through the terminal portion 120 of the guide groove 119.

Since in the present embodiment, the buffer portion 112 is disposed on the side of the ink tank 102, the atmosphere open position is disposed at a location far from the atmosphere communicating port 113. It is desirable that the guide groove 119 be made as long as possible in order to prevent the evaporation of the ink. Also, in the present embodiment, an outside buffer portion 122 is provided in the course of the guide groove 119 to thereby increase the space capable of temporarily detaining the ink therein. By doing so, the leakage of the ink can also be reliably prevented. As shown in FIG. 9, the depth of that portion of the guide groove 119 which is just before the terminal portion 120 in contact with the atmosphere is formed larger by 0.1 mm or more than the depth of the other portion of the guide groove to thereby prevent the guide groove 119 from being crushed by the energy when the lid 116 is welded to the housing of the ink tank, and the communication with the atmosphere from being hampered.

Bottom Surface Buffer Portion

The bottom surface buffer portion provided in the ink tank of the present invention will now be described with reference to FIGS. 1 and 2.

When the ink in the absorbing member 110 is moved to the bottom surface side of the ink tank 102 by gravity, the ink may concentrate in the vicinity of the supplying member 111 and leak from the supply port 108 to the outside.

In the present embodiment, as shown in FIG. 1, the inclination of the absorbing member 110 is prevented by the ribs provided on the bottom surface of the ink tank 102 and a space (bottom surface buffer portion 121) is provided between the bottom surface of the interior of the ink tank 102 and the absorbing member 110. The ink moved from the absorbing member 110 to the bottom surface side of the interior of the ink tank is temporarily retracted to the bottom surface buffer portion 121 to thereby prevent the ink from concentrating in the ink supply port 108.

Also, the ink moved to the bottom surface side temporarily separates from the absorbing member 110 and therefore does not affect the supply pressure of the ink to the recording head 105. Further, during printing, the ink tank 102 is scanned, whereby the ink in the bottom surface buffer portion 121 is again absorbed into the absorbing member 110 and is used for printing.

In the present embodiment, the height of the ribs for maintaining the bottom surface buffer portion 121 is made lower by about 0.75 mm than the upper surface of the supplying member 111 to thereby eliminate any hindrance to the abutting of the supplying member 111 against the absorbing member 110. The height of the ribs may desirably be 2.5 mm to 3.5 mm.

Also, in the ink tank 102 of the present embodiment, as shown in FIG. 1, a clearance 131 is provided between the absorbing member 110 and the inner wall of the ink tank, and the bottom surface buffer portion 121 and the buffer portion 112 communicate with each other by this clearance 131. Thereby, the ink overflowing to the bottom surface buffer portion 121 is prevented from further leaking out from the recording head 105 due to the ambient temperature rise. The fiber absorbing material used as the absorbing member 110, as described above, is of a convex shape swollen outwardly and having an elastic force, but the cut cross-section thereof cut orthogonally to the direction of fiber is hardly swollen. Consequently, the fiber absorbing material is cut into a dimension somewhat smaller than the dimension of the inner wall of the ink tank 102, whereby the above-mentioned clearance 131 can be formed between the cut cross-section and the inner wall surface of the ink tank. Thereby, it becomes possible to form the clearance 131 heretofore formed by ribs or the like, without ribs. The close contact between the inner wall of the. ink tank and the absorbing member 110 is secured by the above-described elastic force of the absorbing member 110 and therefore, the deviation of the absorbing member can be prevented and the clearance 131 can be reliably maintained.

Recording Head Cartridge

A recording head cartridge on which the ink tank of the present invention is mounted will now be described with reference to FIGS. 10A to 13C.

The recording head cartridge is of a construction having a nozzle portion as a recording head for discharging the ink on the basis of a recording signal which is an electrical signal for ink discharge, and an ink tank holder for detachably holding the ink tank containing the ink therein. The nozzle portion is provided in the bottom of the recording head cartridge, and the ink is discharged downwardly from the recording head cartridge.

Figure 10A:
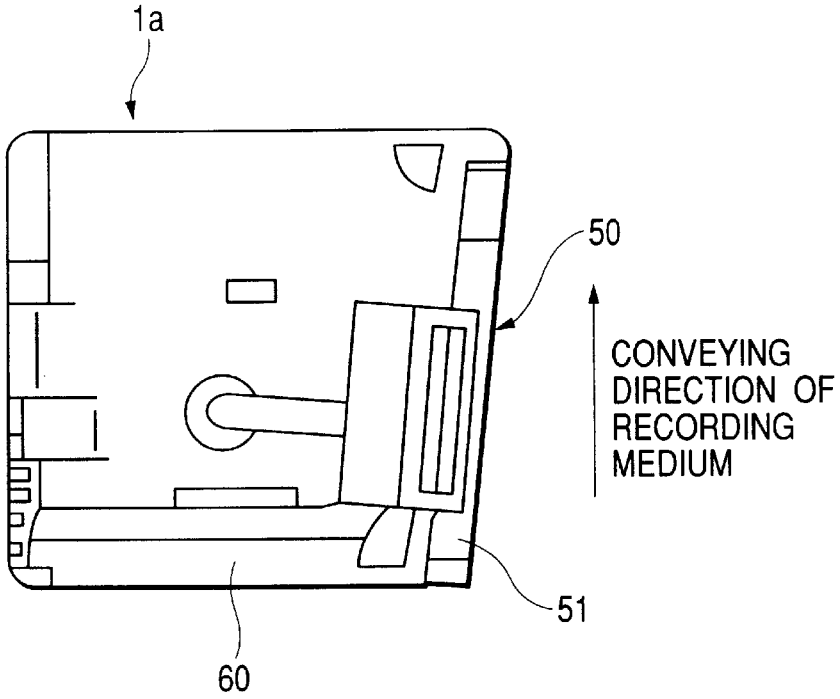
FIGS. 10A and 10B show the constructions of recording head cartridges including ink tank holders, FIG. 10A being a bottom plan view showing an example of the construction of a monocolor holder in which a black ink tank is mounted, FIG. 10B being a bottom plan view showing an example of the construction of a color holder in which a color ink tank is mounted.
Figure 10B:
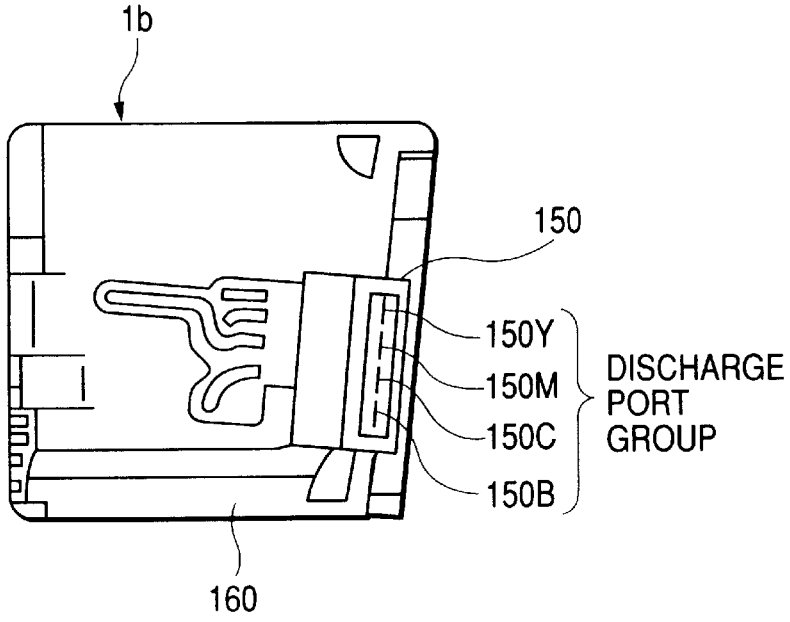

FIGS. 10A and 10B show the constructions of the recording head cartridges including the ink tank holders, FIG. 10A being a bottom plan view showing an example of the construction of a monocolor holder on which a black ink tank containing only black ink therein is mounted, FIG. 10B being a bottom plan view showing an example of the construction of a color holder on which a color ink tank containing color ink therein is mounted.

The recording head cartridge 1*a* shown in FIG. 10A is a cartridge for monocolor, and comprises a nozzle portion 50 for discharging the ink, and a monocolor holder 60 of a box-like shape having an opening portion in the upper surface thereof, the nozzle portion 50 and the monocolor holder 60 being made integral with each other, and an ink tank containing ink of monocolor therein is detachably mounted in the monocolor holder 60.

An electro-thermal conversion member (such as a heat generating resistance member, not shown) for generating energy for ink discharge is disposed on a base plate 51 formed of a metal such as aluminum. Also, the base plate 51 is formed with a head positioning cut-away in which a square head positioning projection 2*d* is fitted and a head positioning aperture in which a round head positioning projection 2*e* is fitted when the recording head cartridge la is mounted on a carriage 2 which will be described later, correspondingly to the locations of the respective head positioning projections 2*d* and 2*e* (see FIG. 14) of the carriage 2.

Also, the recording head cartridge 1*b* shown in FIG. 10B is provided with a color holder 160 in which a black ink tank containing black ink therein and color ink tanks containing yellow, magenta and cyan inks, respectively, therein are detachably mountable, and discharges inks of four colors. Therefore, the nozzle portion 150 is divided into a discharge port group 150B for black, a discharge port group 150Y for yellow, a discharge port group 150M for magenta, and a discharge port group 150C for cyan correspondingly to the inks of respective colors.

A color holder 160 shown in FIG. 10B and the monocolor holder shown in FIG. 10A are capable of being carried on the same carriage, and by interchanging the recording head cartridge, printing in any of monochrome and color is possible.

Figure 11C:
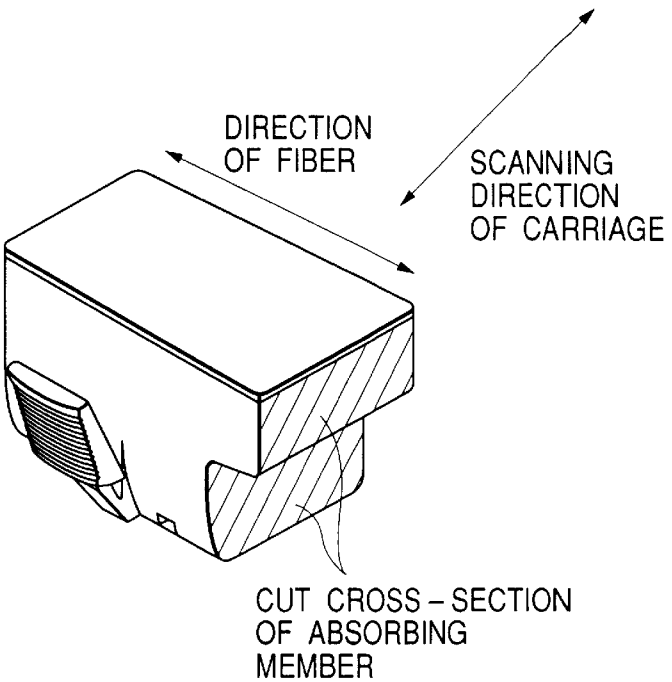
FIGS. 11A, 11B and 11C show the shape of an ink tank for monocolor, FIG. 11A being a side view, FIG. 11B being a bottom plan view including an ink inlet port, FIG. 11C being a perspective view.
Figure 11B:
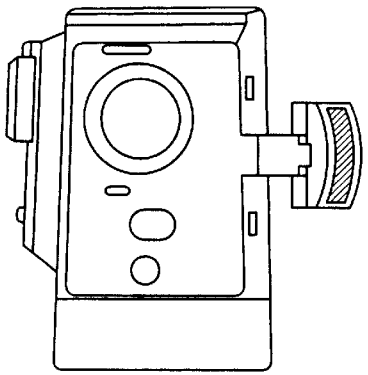
Figure 11A:
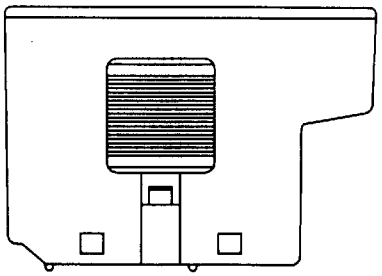

FIGS. 11A, 11B and 11C show the shape of the ink tank containing ink of monocolor therein, FIG. 11A being a side view, FIG. 11B being a bottom plan view including an ink inlet, FIG. 11C being a perspective view.

The above-described absorbing member comprising a fiber absorbing material is contained in the ink tank for monocolor shown in FIGS. 11A, 11B and 11C, and the ink of monocolor is held therein by a capillary force created by the absorbing member. The direction of fiber of the fiber absorbing material, as shown in FIG. 1C, is a direction parallel to the direction toward the buffer portion. The convex surface of the absorbing member 110 is located or the surface of the ink tank having a maximum area, whereby the close contact between the inner wall of the ink tank and the absorbing member can be reliably secured, and the deviation of the absorbing member is restrained. Conversely, the cut cross-sectional surface of the fiber absorbing material, as indicated by a hatched portion in FIG. 11C, is located on the minimum area surface of the interior of the ink tank. The fiber absorbing material is cut in a direction substantially perpendicular to the direction of fiber. By the cut cross-sectional surface being located on the minimum area surface as described above, it becomes possible to minimize the ink (free ink) flowing out of the absorbing member along the direction of fiber.

Also, as shown in FIG. 11C, the direction of fiber is arranged in a direction intersecting with the scanning direction of the carriage (a direction horizontal to the direction of gravity) and therefore, it is possible to restrain the movement of the ink in the fiber absorbing material resulting from the movement of the carriage.

The ink tank for monocolor shown in FIGS. 11A to 11C is mounted by fitting a lock portion by an elastic latch lever provided in the tank container into the opening portion of the monocolor holder 60 shown in FIG. 10A. By a mounting mechanism having the elastic latch lever as described above, mounting and dismounting of good operability becomes possible in a small space. Also, in the present embodiment, the absorbing member 110 in the ink tank of FIGS. 11A to 11C is formed of fibers of 6D (denier), and the absorbing member 111 is formed of fibers of 2D.

Figure 12C:
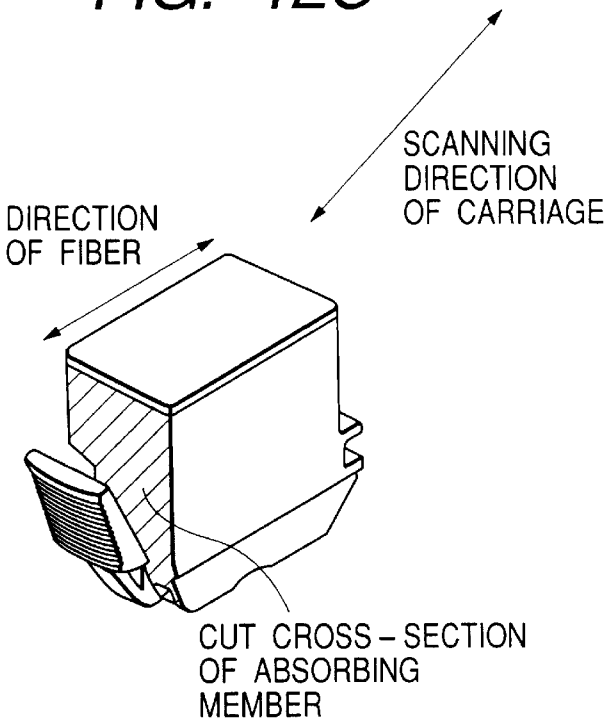
FIGS. 12A, 12B and 12C show the shape of an ink tank for black, FIG. 12A being a side view, FIG. 12B being a bottom plan view including an ink inlet port, FIG. 12C being a perspective view.
Figure 12B:
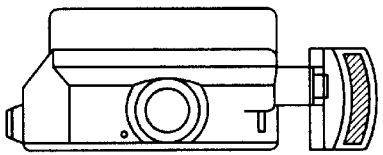
Figure 12A:
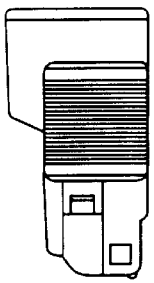
Figure 13C:
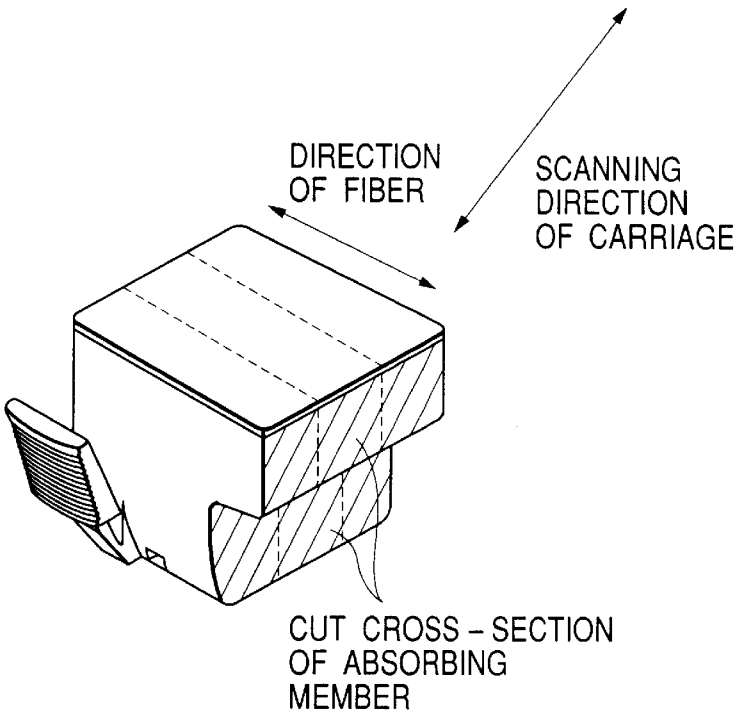
FIGS. 13A, 13B and 13C show the shape of an ink tank for color, FIG. 13A being a side view, FIG. 13B being a bottom plan view including an ink inlet port, and FIG. 13C being a perspective view.
Figure 13B:
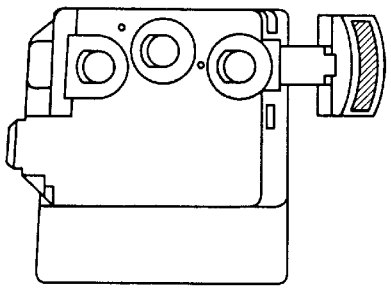
Figure 13A:
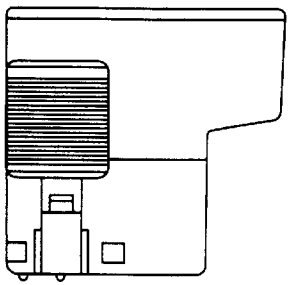

On the other hand, the black ink tank shown in FIGS. 12A to 12C and the color ink tank shown in FIGS. 13A to 13C are mountable in the color holder shown in FIG. 10B, and yellow, magenta, cyan and black inks can be supplied to the recording head.

FIGS. 12A, 12B and 12C show the shape of the black ink tank containing black ink therein, FIG. 12A being a side view, FIG. 12B being a bottom plan view including an ink inlet, FIG. 12C being a perspective view. FIGS. 13A, 13B and 13C show the shape of the color ink tank containing color ink therein, FIG. 13A being a side view, FIG. 13B being a bottom plan view including an ink inlet, FIG. 13C being a perspective view.

The black ink tank shown in FIGS. 12A to 12C contains only black ink therein, and is of a small type as compared with the ink tank for monocolor shown in FIGS. 11A to 11C. An absorbing member formed of a fiber absorbing material is contained in the black ink tank, as in the ink tank for monocolor shown in FIGS. 11A to 11C. The ink is discharged from the ink tank through the absorbing member to the supplying member disposed in the ink supply port, and is directed to the recording head.

The direction of fiber of the fiber absorbing material is a direction shown in FIG. 12C, i.e., a direction orthogonal to the direction from the absorbing member toward the buffer portion. Thereby, the ink in the ink tank is restrained from moving to the buffer portion. Also, as in the ink tank of FIGS. 11A to 11C, the cut cross-section of the fiber absorbing material is located on the minimum area surface of the interior of the ink tank and therefore, the free ink can be prevented. Also, as previously described, the direction from the absorbing member toward the buffer portion intersects with the scanning direction of the carriage and therefore, the movement of the ink to the buffer portion can be prevented. Like the ink tank for monocolor shown in FIGS. 11A to 11C, this ink tank is mounted in a color holder 160 by the use of an elastic latch lever. Also, in the ink tank of FIGS. 12A to 12C, in the present embodiment, both of the absorbing member 110 and the supplying member 111 are formed of fibers of 6D (denier).

Also, the color ink tank shown in FIGS. 13A to 13C has its interior partitioned into three chambers, in which yellow, magenta and cyan inks are contained, respectively. Also, the above-described absorbing member formed of the fiber absorbing material is contained in each of the chambers. As in FIGS. 12A to 12C, both of the absorbing member 110 and the supplying member 111 are formed of fibers of 6D (denier).

The direction of fiber of the fiber absorbing material is a direction shown in FIG. 13C, as in the ink tank for monocolor shown in FIGS. 11A to 11C. The cut cross-section of the fiber absorbing material is likewise located on the minimum area surface of the ink tank. Also, the direction from the absorbing member toward the buffer portion likewise intersects with (is substantially orthogonal to) the scanning direction of the carriage and therefore, the movement of the ink to the buffer portion can be prevented. Like the ink tank for monocolor shown in FIGS. 11A to 11C, this ink tank is mounted in the color holder 160 by the use of an elastic latch lever.

Carriage

The carriage will now be described with reference to FIG. 14.

Figure 14:
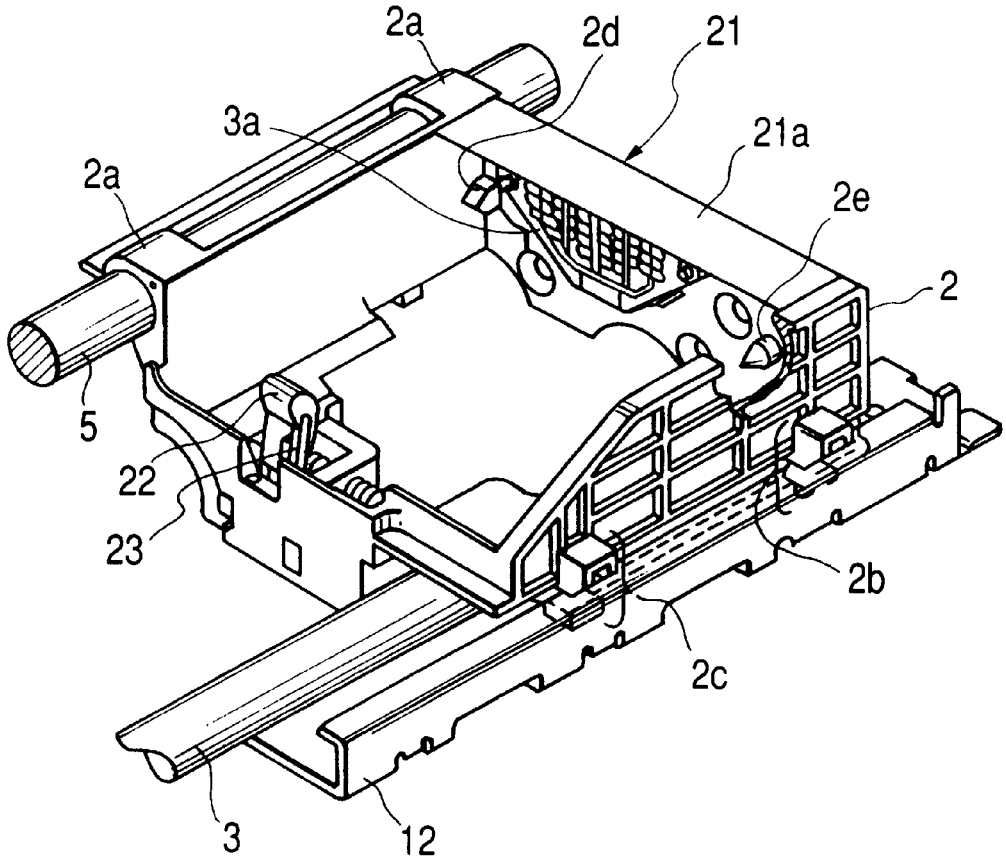
FIG. 14 is a perspective view showing an example of the construction of a carriage provided in an ink jet recording apparatus.

FIG. 14 is a perspective view showing an example of the construction of the carriage provided in an ink jet recording apparatus.

As shown in FIG. 14, the carriage 2 is generally of a frame shape, and the recording head cartridge 1 is mounted in the hollow portion thereof. Two bearing portions 2*a* are integrally provided on the back of the carriage 2, and a guide shaft 5 is inserted into these bearing portions 2*a*. Also, a guide rail sandwiching portion 2*b* and a stopper 2*c* for preventing the deformation of the carriage are integrally provided as two sandwiching portions on the front surface of the carriage 2. The guide rail sandwiching portion 2*b* is provided on a cable keeper 21 side, and the stopper 2*c* for preventing the deformation of the carriage is provided on a head guide 22 side. Each of the guide rail sandwiching portion 2*b* and the stopper 2*c* for preventing the deformation of the carriage is comprised of two members projectedly provided at an interval in a vertical direction with a plate-like guide rail 12 therebetween. Thus, the carriage 2 is supported by he two bearing portions 2*a*, the guide rail sandwiching portion 2*b* and the stopper 2*c* for preventing the deformation of the carriage. Thereby, the carriage 2 is supported so as to become parallel to a base 14 (see FIG. 15), and the distance between the nozzle portion (see FIGS. 10A and 10B) of the recording head cartridge mounted on the carriage 2 and a recording medium P is kept substantially constant.

A flexible cable 3 is passed along a predetermined route, and is fixed by the cable keeper 21 so that a cable terminal portion 3*a* provided at the distal end portion thereof may be located inside the right side wall as viewed in FIG. 14. When the recording head cartridge 1 is mounted on the carriage 2, the head terminal portion 53 (not shown) of the recording head cartridge 1 abuts against the cable terminal portion 3*a*, whereby the electrical connection of the cable terminal portion 3*a* to the recording head cartridge 1 is made.

Two head positioning projections 2*d* and 2*e* are integrally provided on that surface of the carriage 2 on which the cable terminal portion 3*a* is located. One head positioning projection 2*d* is square and is provided on the more inner side than the cable terminal portion 3*a*. The other head positioning projection 2*e* has a conical tip end portion and is provided on this side of the cable terminal portion 3*a*. In a state in which the recording head cartridge 1 has been mounted on the carriage 2, one head positioning projection 2*d* is fitted in the head positioning cut-away (not shown) of the recording head cartridge 1 and the other head positioning projection 2*e* is fitted in the head positioning aperture (not shown) of the recording head cartridge 1, whereby the accurate positioning of the recording head cartridge 1 relative to the carriage 2 is done.

A contact spring 23 is provided at that region of the carriage 2 which is opposed to the cable terminal portion 3*a*, and a head guide 22 formed of resin is secured to the fore end portion thereof. That is, the head guide 22 is elastically supported on the carriage 2. In a state in which the recording head cartridge 1 is mounted on the carriage 2, the head guide 22 is fitted to the head pressing portion (not shown) of the recording head cartridge 1, and biases the recording head cartridge 1 toward the cable terminal portion 3*a* by the spring force of the contact spring 23, and the cable terminal portion 3*a* and the head guide 22 are disposed in opposed relationship with each other, whereby the contact between the cable terminal portion 3*a* and the head terminal portion is ensured. The head guide 22 serves also as a guide when the recording head cartridge 1 is mounted on the carriage 2.

Ink Jet Recording Apparatus

An ink jet recording apparatus carrying thereon the recording head cartridge in which the above-described ink tank of the present invention is mountable will now be described with reference to FIG. 15.

Figure 15:
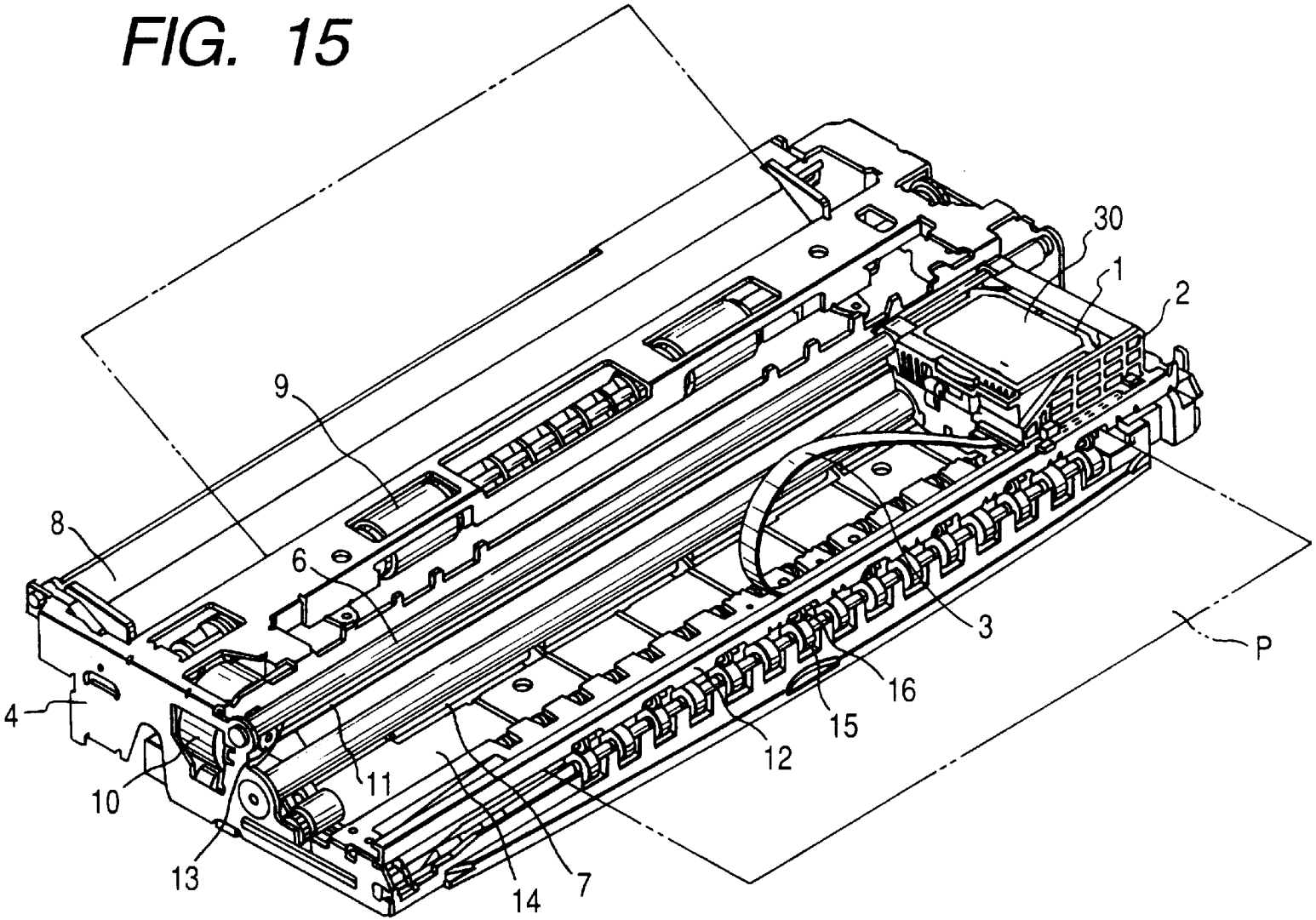
FIG. 15 is a perspective view showing an example of the construction of an ink jet recording apparatus carrying a recording head cartridge thereon.

FIG. 15 is a perspective view showing an example of the construction of the ink jet recording apparatus carrying the recording head cartridge thereon. FIG. 15 shows a state in which a cover has been removed.

In FIG. 15, the carriage 2 removably carries the recording head cartridge 1 thereon, and is supported on a guide shaft 5 and a guide rail 12 having their opposite end portions fixed to a frame and disposed parallel to each other for sliding movement in a direction orthogonal to the conveying direction of the recording medium P and parallel to the plane of the recording medium P. Also, the carriage 2 is coupled to a region of a carriage driving belt 11 passed over a driving pulley 13 secured to the output shaft of a carriage driving motor 10 and a rotatably journalled pulley (not shown), and by the carriage driving motor 10 being driven, the carriage driving belt 11 is rotated, whereby the carriage may be reciprocally moved in the above-mentioned direction.

A recording signal to the nozzle portion of the recording head cartridge 1 is transmitted from a control substrate (not shown) for controlling the operation of the ink jet recording apparatus, for example, through the flexible cable 3 provided on the carriage 2. The flexible cable 3 is disposed along the moving direction of the carriage 2, and forms a loop with the movement of the carriage 2.

On the other hand, the recording mediums P are stacked on a pressure plate 8 having its opposite end portions rotatably supported on the frame 4. The pressure plate 8 is biased toward a pickup roller 9 by biasing means (not shown), and the recording mediums P stacked on the pressure plate 8 are urged against the pickup roller 9. When the pickup roller 9 is rotated by a sheet feeding command, a recording medium P is fed out by the frictional force between the pickup roller 9 and the recording medium P, but the pressure plate 8 has separating means (not shown) such as a separating pawl as used in a conventional automatic sheet feeding apparatus, and only the uppermost recording mediums P is fed by the action of this separating means.

The recording medium P fed out by the pickup roller 9 is conveyed to below the carriage 2 while being nipped between a conveying roller 6 having its opposite end portions supported on the frame 4 and a pinch roller 7 provided on a base 14. At this position, recording is effected on the recording medium P. Further, a sheet discharge roller 15 and a spur 16 are disposed in opposed relationship with each other downstream of the carriage 2 with respect to the conveying direction of the recording medium P, and the recording medium P passed below the carriage 2 is discharged by being nipped between the sheet discharge roller 15 and the spur 16. The driving of the above-described pickup roller 9, conveying roller 6 and sheet discharge roller 5 is effected with a sheet feeding motor (not shown) as a drive source.

The present invention brings about an excellent effect particularly in a recording head and a recording apparatus of an ink jet type which utilizes heat energy to form flying liquid droplets and effect recording, among the ink jet recording types.

With regard to its typical construction and principle, a system using the basic principle disclosed, for example, in U.S. Pat. No. 4,723,129 and U.S. Pat. No. 4,740,796 is preferable. This system is applicable to both of the so-called on-demand type and the continuous type, and particularly in the case of the on-demand type, at least one driving signal corresponding to recording information and providing a rapid temperature rise exceeding nuclear boiling is applied to an electro-thermal conversion member disposed correspondingly to a sheet or a liquid path in which liquid (ink) is held, whereby heat energy is generated in the electro-thermal conversion member and film boiling is caused in the heat acting surface of the recording head with a result that a bubble in the liquid (ink) corresponding at one to one to this driving signal can be formed, and this is effective. By the growth and contraction of this bubble, the liquid (ink) is discharged through a discharge opening to thereby form at least one droplet. When this driving signal is made into a pulse shape, the growth and contraction of the bubble take place on the spot and therefore, the discharge of the liquid (ink) particularly excellent in responsiveness can be achieved, and this is more preferable.

As this pulse-shaped driving signal, one as described in U.S. Pat. No. 4,463,359 and U.S. Pat. No. 4,345,262 is suitable. If the condition described in U.S. Pat. No. 4,313,124 covering an invention relating to the temperature rise rate of the above-mentioned heat acting surface is adopted, more excellent recording can be accomplished.

As the construction of the recording head, besides the combined construction of a discharge port, a liquid path and an electro-thermal conversion member as disclosed in the above-mentioned patents (a linear liquid path or a right-angled liquid flow path), the construction using U.S. Pat. No. 4,558,333 and U.S. Pat. No. 4,459,600 disclosing a construction in which the heat acting portion is disposed in a bent area is also covered by the present invention.

In addition, constructions based on Japanese Patent Application Laid-Open No. 59-123670 disclosing a construction in which a slit common to a plurality of electro-thermal conversion members is the discharge portion of the electro-thermal conversion members and Japanese Patent Application Laid-Open No. 59-138461 disclosing a construction in which an opening for absorbing the pressure wave of heat energy corresponds to a discharge portion may be effectively adopted in the present invention.

Further, as a recording head of the full line type having a length corresponding to the width of the largest recording medium on which a recording apparatus can record, there may be adopted any of the construction as disclosed in the above-mentioned publications wherein the length is satisfied by a combination of a plurality of recording heads, and the construction as an integrally formed recording head.

Also, it is preferable to add recovery means, preliminary auxiliary means, etc. for the recording head provided as the construction of the recording apparatus of the present invention because they can more stabilize the effect of the present invention. Specifically mentioning these, they are capping means for the recording head, cleaning means, pressurizing or sucking means, an electro-thermal conversion member or a heating element discrete therefrom or preliminary heating means by a combination of these, and it is also effective for effecting stable recording to effect a preliminary discharge mode for effecting discharge discrete from recording.

In addition, the forms of the recording apparatus according to the present invention may be, besides an apparatus provided integrally or discretely as the image output terminal of an information processing apparatus such as a word processor or a computer, the forms of a copying apparatus combined with a reader and further, a facsimile apparatus having the transmitting and receiving functions.

The present invention which is constructed as described above achieves the following effects.

The buffer portion is disposed in a direction intersecting with the scanning direction of the carriage, whereby the ink only moves in the interior of the absorbing member and does not move to the buffer portion and therefore, any change in the negative pressure in the ink tank is restrained and the influence upon printing can be reduced. Also, even if the carriage changes its scanning direction, whereby an inertia force acts on the ink in the ink tank, the ink will not directly move into the buffer portion and therefore, the leakage of the ink from the atmosphere communicating port can be restrained. Also, even when the ink overflows into the buffer portion, the ink is again taken in from the side portion of the ink absorbing member and therefore, the ink can be well used up.

On the other hand, the two opposed surfaces of the absorbing member form an outwardly swelling convex shape, and provision is made of the bottom surface buffer portion disposed between the absorbing member and the bottom surface of the ink tank and capable of temporarily containing the ink therein, and the clearance communicating the buffer portion and the bottom surface buffer portion with each other, whereby the ink moved from the absorbing member to the bottom surface side of the interior of the ink tank can be temporarily retracted into the bottom surface buffer portion and therefore, the ink is prevented from concentrating in the ink supply port. Further, the ink tank is scanned during printing, whereby the ink in the bottom surface buffer portion is again absorbed into the absorbing member and is used for printing. Further, the bottom surface buffer portion and the buffer portion are communicated with each other by the clearance, whereby the ink overflowing into the bottom surface buffer portion can be prevented from further leaking out of the recording head due to the ambient temperature rise.

What is claimed is:

1. An ink tank removably mountable with a carriage which scans in a scanning direction, said ink tank comprising:

an absorbing member for holding ink to be supplied to a recording head for discharging ink to thereby effect recording, wherein said absorbing member comprises a fiber absorbing material in which a density of an outer peripheral portion thereof is higher than that of an interior portion thereof, and wherein said fiber absorbing material is comprised of a plurality of fibers bundled substantially in a common fibrous direction, and wherein said fiber absorbing material has a cut cross-section cut in a direction substantially orthogonal to the fibrous direction, and said cut cross-section is disposed in opposed relationship with a minimum area surface of an inner surface of said ink tank;

a tank container containing said absorbing member therein, a buffer portion constructed to temporarily contain said ink therein, and an atmosphere communicating port disposed in said buffer portion and communicating an interior of said tank container with atmosphere, and a bottom surface buffer portion disposed between said absorbing member and a bottom surface of said tank container and constructed to temporarily contain said ink therein, wherein a clearance is provided between the cut cross-section and the inner surface of said ink tank, so as to communicate said buffer portion and said bottom surface buffer portion with each other, and wherein said buffer portion is disposed on a side portion of said absorbing member, and a direction from said absorbing member toward said buffer portion is a direction intersecting with the scanning direction of the carriage when said ink tank is mounted therewith.

2. An ink tank according to claim 1, wherein said absorbing member is provided with a surface having a convex shape in a direction substantially orthogonal to the fibrous direction.

3. An ink tank according to claim 2, wherein the surface of said absorbing member having the convex shape is located on a surface provided with a maximum area of an inner surface of the tank container.

4. An ink tank according to claim 1, wherein the fibrous direction is a direction substantially orthogonal to the direction from said absorbing member toward said buffer portion.

5. An ink tank according to claim 1, wherein the fibrous direction is a direction substantially parallel to the direction from said absorbing member toward said buffer portion.

6. An ink tank according to claim 1, wherein said atmosphere communicating port comprises tubular members of different inner diameters.

7. An ink tank according to claim 6, wherein an internal opening of said atmosphere communicating port is located substantially in a central region of said buffer portion.

8. An ink tank according to claim 1, wherein a bottom surface of said buffer portion is inclined in a direction toward said absorbing member.

9. An ink tank according to claim 1, wherein said absorbing member is compressed in a lower region of said buffer portion.

10. A recording head cartridge comprising:

a recording head having an ink tank according to claim 8 removably carried thereon, and discharging ink to thereby effect recording; and a supply tube for directing the ink from said ink tank to said recording head.

11. An ink jet recording apparatus comprising:

a recording head cartridge according to claim 10; and a carriage having said recording head cartridge removably carried thereon, and scanned in the scanning direction along a recording medium.

12. An ink tank comprising:

an absorbing member for holding ink to be supplied to a recording head for discharging ink to thereby effect recording, a tank container containing said absorbing member therein, a buffer portion constructed to temporarily contain said ink therein, and an atmosphere communicating port disposed in said buffer portion and communicating an interior of said tank container with atmosphere, wherein said absorbing member has at least two opposed surfaces forming an outwardly swelling convex shape, and wherein said ink tank further comprises a bottom surface buffer portion disposed between said absorbing member and a bottom surface of said ink tank and constructed to temporarily contain said ink therein, and a clearance communicating said buffer portion and said bottom surface buffer portion with each other.

13. An ink tank according to claim 12, wherein said absorbing member comprises a fiber absorbing material whose fibers are bundled substantially in a common fibrous direction, and is provided with a surface having a convex shape in a direction substantially orthogonal to the fibrous direction.

14. An ink tank according to claim 12, wherein at least one of the two opposed surfaces of said absorbing member is located on a surface provided with a maximum area of an inner surface of said ink tank.

15. An ink tank according to claim 12, wherein said buffer portion is disposed on a side of said absorbing member.

16. A recording head cartridge comprising:

a recording head having an ink tank according to claim 9 removably carried thereon, and discharging ink to thereby effect recording; and a supply tube for directing the ink from said ink tank to said recording head.

17. An ink jet recording apparatus comprising:

a recording head cartridge according to claim 16; and a carriage having said recording head cartridge removably carried thereon, and scanned in a scanning direction along a recording medium.

* * * * *

UNITED STATES PATENT AND TRADEMARK OFFICE

CERTIFICATE OF CORRECTION

PATENT NO. : 6,419,350 B1
DATED : July 16, 2002
INVENTOR(S) : Tsutomu Abe et al.

It is certified that error appears in the above-identified patent and that said Letters Patent is hereby corrected as shown below:

Column 3,
Line 5, “views” should read -- view --.

Column 4,
Line 57, “he” should read -- be --.

Column 9,
Line 14, “inclination a” should read -- inclination α --; and “into” should read -- ink tank --.

Column 10,
Line 34, “comes:” should read -- comes --

Column 12,
Line 30, “1a” should read -- 1*a* --; and
Line 60, “1C,” should read -- 11C, --.

Column 14,
Line 42, “he” should read -- the --.

Signed and Sealed this

Fourth Day of February, 2003

JAMES E. ROGAN
*Director of the United States Patent and Trademark Office*